United States Patent [19]

Donatelle

[11] 4,263,738

[45] Apr. 28, 1981

[54] SIGN ASSEMBLY STRUCTURE

[75] Inventor: Leo P. Donatelle, Chicago, Ill.

[73] Assignee: Spanjer Brothers, Inc., Chicago, Ill.

[21] Appl. No.: 110,201

[22] Filed: Jan. 7, 1980

[51] Int. Cl.[3] ..... G09F 15/00

[52] U.S. Cl. ..... 40/606

[58] Field of Search ..... 40/605, 606, 607, 610

[56] References Cited

U.S. PATENT DOCUMENTS

| | | | |
|---|---|---|---|
| 1,005,375 | 10/1911 | Vanderveld | 40/607 |
| 2,865,124 | 12/1958 | Mortellito | 40/605 |
| 2,993,290 | 7/1961 | Bell et al. | 40/152 |
| 4,068,398 | 1/1978 | Parisi | 40/610 |

FOREIGN PATENT DOCUMENTS

| | | | |
|---|---|---|---|
| 2330689 | 6/1973 | Fed. Rep. of Germany | 40/607 |

*Primary Examiner*—Gene Mancene
*Assistant Examiner*—Wenceslao J. Contreras
*Attorney, Agent, or Firm*—Rummler & Snow

[57] ABSTRACT

A simple lockup device for a sign having a square tubular extrusion for a post with grooved webs extending midway up the length of the interior of T-section sidewalls of the same, one sidewall web being slotted through its groove partially down from the top of the post for receiving the flange of a sign panel installed in interlocking relation therewith. A locking key bent of a rectangular strip of sheetmetal engages a vertical slot in the top of the panel flange at its middle and at its conjugate ends engages with the grooves in the webs on adjacent sidewalls of the post. A closing cap inserts four depending lugs in four corners of the top of the post in mounting on top of the same.

3 Claims, 7 Drawing Figures

SIGN ASSEMBLY STRUCTURE

BACKGROUND OF THE INVENTION

Signs for advertising and instructional display purposes are in general complex in construction and lack lockup tightness and structural integrity.

SUMMARY OF THE INVENTION

The gist of this invention lies in a signpost comprising a square tube with T-section sidewalls having grooved webs extending midway up the interior of the same, one web of which is slotted through the tubular sidewall partway from the top of the post down for engaging and interlocking with a flange on the sign panel having a mating slot extending partway up from the bottom thereof. A locking key bent from a rectangular strip of sheet metal engages at its middle a slot in the top of the panel flange extending partway down from the top thereof and at each of its ends engages the grooves in the webs on adjacent T-section sidewalls of the post. A square cap inserts depending lugs in the four corners of the top of the post between the webs thereof for mounting on and closing off the same.

DESCRIPTION OF THE PREFERRED EMBODIMENTS

Figure 1:
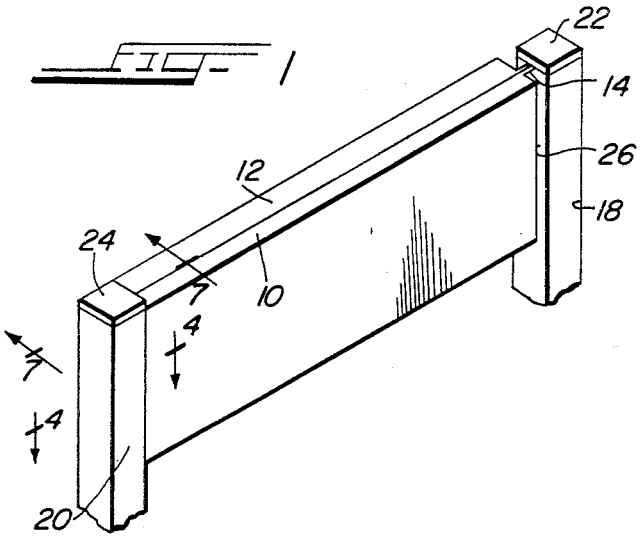
FIG. 1 shows a fragmentary perspective view of a sign incorporating the extruded signpost of this invention.

Referring to FIG. 1, the signpost lockup comprises rectangular display panels 10 and 12 having flanges 14 and 16 (not shown) extending vertically along opposed sides thereof between and in interlocking relationship with downward slots 26 and 28 (not shown) of the sidewalls of signposts 18 and 20, respectively, and having caps 22 and 24 inserting in the tops of the same for final closure.

Figure 4:
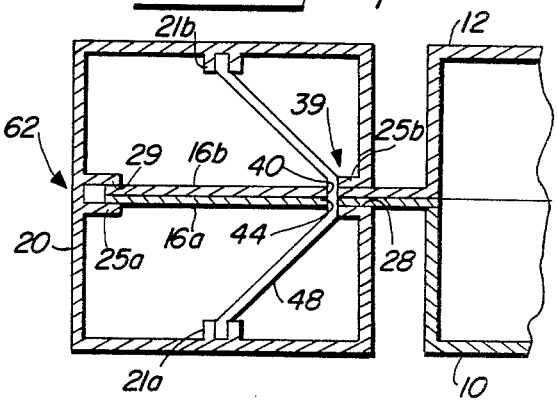
FIG. 4 shows the same as for FIG. 3 but adapted for a double-flanged display panel.
Figure 6:
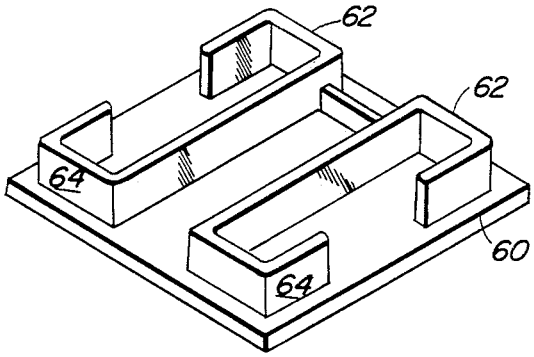
FIG. 6 shows a perspective view of the lugged base of the closure cap for the post.
Figure 2:
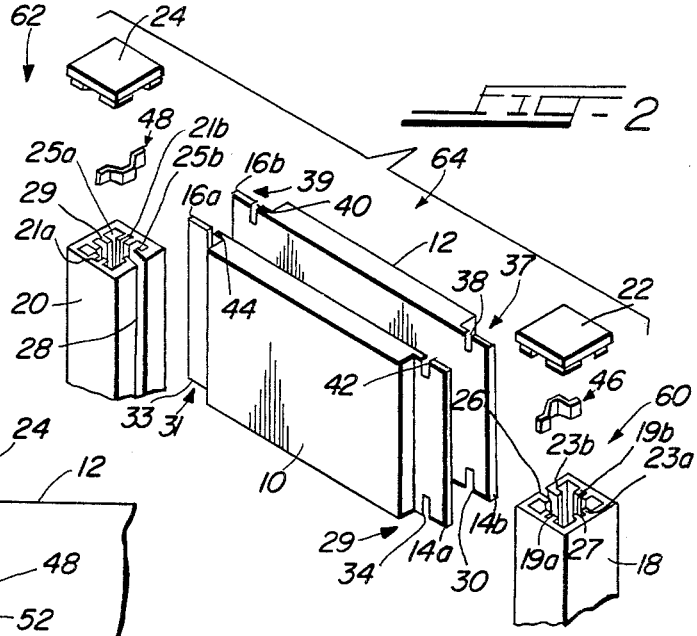
FIG. 2 shows a fragmentary exploded view of the parts of the sign assembly of FIG. 1.
Figure 7:
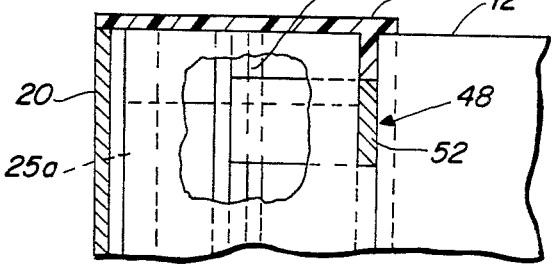
FIG. 7 shows a fragmentary cross-section of the sign assembly taken along line 7—7 of FIG. 1.

Referring to the exploded view of FIG. 2 and the cross-section of FIG. 4, posts 18 and 20 have webs 19*a* and 19*b* and 21*a* and 21*b*, and 23*a* and 23*b* and 25*a* and 25*b* extending midway down the interior of their respective sidewalls, and rectangular flange members 14*a*, 14*b*, 16*a* and 16*b* mounting on opposite sides of display panels 10 and 12 and extending therealong for a distance which is somewhat greater than the downward extension of slots 26 and 28 in the posts 18 and 20. Webs 23*a* and 23*b* and 25*a* and 25*b* in posts 18 and 20 have through-slots 26 and 28 for the support of flanges 14 and 16 on the sidewalls of posts 18 and 20, and bottomed grooves 27 (not shown) and 29, respectively, milled partway down the same midway through the sidewalls of each post 18 and 20 from the top thereof for stabilizing flanges 14 and 16 upon insertion through the sidewalls of posts 18 and 20.

Bottom flange lockups 29 and 31, as shown in FIG. 2, comprise upward slots 30 and 34 and 33 and 35 (not shown) in flanges 14 and 16, respectively, having widths slightly greater than the sidewall thickness of the posts 18 and 20 at the bottom of the grooves in the webs 23*b* and 25*b* thereof, which upward slots slidingly mate with the bottom of downward slots 26 and 28 in the posts 18 and 20.

Figure 3:
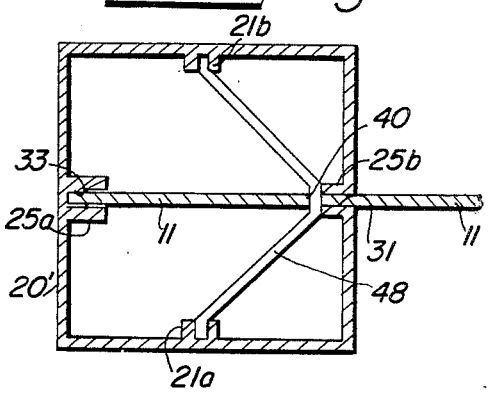
FIG. 3 shows a top cross-sectional view of the signpost of FIG. 1 adapted for a single-flanged display panel.

Top lockups 37 and 39, as shown in FIGS. 2, 3 and 4, comprise downward slots 38 and 40 and 42 and 44 in flanges 14 and 16, respectively, also having widths slightly greater than the sidewall thickness of the posts 18 and 20 at the bottom of the grooves in the webs 23*b* and 25*b* thereof.

Figure 5:
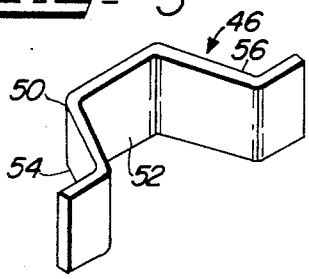
FIG. 5 shows a perspective view of the key for locking up the sign.

Lockup keys 46 and 48, as shown in FIGS. 2, 4 and 5, are made of bent rectangular sheet metal strips 59 having a thickness slightly less than the width of downward slots 38 and 40 and 42 and 44 in flanges 14 and 16 and the width of the grooves in webs 21*a* and 21*b*, respectively, and comprise a crosshead member 52, opposed diagonal leg members 54 and 56 connected at their conjugate ends each to an opposite side of crosshead 52 and opposed feet members 58 and 60 connected at their respective conjugate ends each to the other ends of legs 54 and 56, and lying in the same plane as crosshead member 52. Crosshead 52 slidingly inserts in downward slots 38 and 40, and 42 and 44 in flanges 14 and 16 and feet 58 and 60 slidingly insert in grooves in webs 21*a* and 21*b*, respectively.

Lockup stabilizers 60 and 62, as shown in FIGS. 3 and 4, comprise bottomed grooves 27 and 29 which are milled in webs 23*a* and 25*a*, having widths slightly greater than the thickness of flanges 14*a* and 14*b* and 16*a* and 16*b*, respectively. Flanges 14*a* and 14*b* and 16*a* and 16*b* slidingly insert in milled grooves 27 and 29 upon insertion of the flanges through slots 26 and 28 in the sidewalls of posts 18 and 20 for stabilizing the same.

Caps 22 and 24, as shown in FIGS. 1, 2, 3 and 6, are molded of plastic and comprise a top 60 having a flat bottom and four lugs 62 which depend from the bottom thereof and have intersecting vertical sides 64 which define a square of slightly larger dimension than the inside dimension of the square tubular post and are relieved so as not to interfere with the webs 21*a* and 21*b* on the sidewalls thereof or the key 46 in its locking installation therein.

Each post having previously been set in concrete at the site at the proper distance apart and proper relative orientation one to the other, in the assembly of the sign as shown in FIG. 2, a subassembly 64 of panels 10 and 12 placed back-to-back with their flanges 14*a* and 14*b* and 16*a* and 16*b* in face-to-face contact is inserted down in slots 26 and 28 in posts 18 and 20, respectively, engaging the bottom flange lockups 29 and 31. Lockup keys 46 and 48 are then inserted in top lockups 37 and 39. Caps 22 and 24 are then jambed into the top of posts 18 and 20 for final closure.

A single panel display, as shown in FIG. 3, is supported and stabilized as a flange 11 in a bottomed groove 33 in the web 25*a* through a slot 31 in the sidewall of post 20 with a key 48 in the same manner as the double panel display.

It will be understood that details of the construction shown may be altered or omitted without departing from the spirit of the invention as defined by the following claims.

I claim:

1. In a sign having spaced tubular posts, a display panel between said posts having flange elements extending from the sides of the same, slot means at the bottom of said flanges and in the sidewalls of said posts cooperatively supporting said panel in said posts, means on the flanges and in the interior of the sidewalls of said posts for cooperatively stabilizing said panel in said posts, and means at the top of said flanges and in the opposite sidewalls of said posts cooperatively locking-up said panel in said posts, the stabilizing means comprising a web on the interior of the sidewall of said post opposite the said slotted sidewall and having a groove extending down from the top of the post for cooperatively engaging the edge of the flange extending through the slot in the sidewall thereof.

2. In a sign as set forth in claim 1, wherein the locking-up means comprises:

(a) a slot in the flange of said panel extending partially down from the top of the flange adjacent to the interior of the slotted sidewall of said post;

(b) webs on the interior of the opposed sidewalls of said post adjacent to the slotted sidewall of the same having grooves therein extending down from the top of the post; and (c) a means for keying the slot in the top of the flange of the panel to the grooves in the webs on adjacent sidewalls of the same.

3. In a sign as set forth in claim 2, wherein the keying means comprises:

(a) a crosshead having a thickness slightly less than the width of the slot in the flange of the side panel extending down from the top of the flange thereof for cooperatively engaging the same;

(b) conjugate legs connected to each side of said crosshead and extending sidewise therefrom; and (c) feet having a thickness slightly less than the width of the grooves in the webs on the interior of opposed sidewalls of said posts adjacent to the slotted sidewall therebetween connected to each leg on each side of said crosshead and extending sidewise therefrom for cooperatively engaging the grooves in said webs.

* * * * *